US005136905A

United States Patent [19]

Stack et al.

[11] Patent Number: 5,136,905

[45] Date of Patent: Aug. 11, 1992

[54] DEVICE AND METHOD FOR FORMING A GASKET HOLE

[75] Inventors: Joyce I. Stack; Thomas J. Stack, Jr., both of 11464 Dennison Rd., Silver Creek, N.Y. 14136

[73] Assignees: Joyce I. Stack; Thomas J. Stack, both of Silver Creek, N.Y.

[21] Appl. No.: 651,729

[22] Filed: Feb. 7, 1991

[51] Int. Cl.[5] ..... B26F 1/32

[52] U.S. Cl. ..... 83/23; 7/169; 30/358; 72/333; 83/574; 83/685; 83/696

[58] Field of Search ..... 83/15, 50, 51, 109, 83/553, 524, 561, 566, 574, 613, 618, 619, 620, 658, 695, 657, 679, 685, 686, 687, 690, 691, 696, 856; 81/463; 72/75, 333, 343, 479

[56] References Cited

U.S. PATENT DOCUMENTS

| | | | |
|---|---|---|---|
| 1,448,214 | 3/1923 | Harvey | 30/358 |
| 2,048,598 | 7/1936 | Christiansen | 172/75 |
| 2,547,391 | 4/1951 | Hauschild | 7/169 X |
| 2,799,340 | 7/1957 | Mueller | 72/325 |
| 3,327,516 | 6/1967 | Anderson | 72/462 |
| 3,393,550 | 7/1968 | Ihle | 72/333 |
| 4,123,956 | 11/1978 | Harvey | 83/685 X |
| 4,234,375 | 11/1980 | Ciccarello | 156/530 |
| 4,674,372 | 6/1987 | Mobley | 83/685 X |

FOREIGN PATENT DOCUMENTS

| | | | |
|---|---|---|---|
| 631991 | 12/1961 | Canada | 30/358 |
| 903203 | 2/1954 | Fed. Rep. of Germany | 83/685 |
| 563180 | 5/1957 | Italy | 83/685 |

OTHER PUBLICATIONS

Fab-Line, Jun./Jul. 1984, Issue 3, A Strippit/Di-Acro Publication.

Fab-Line, Aug./Sep. 1984, Issue 4, A Strippit/Di-Acro Publication, IMTS '84 Diversified and Dynamic-the Houdaille Machine Tool Group.

*Primary Examiner*—Frank T. Yost
*Assistant Examiner*—Raymond D. Woods
*Attorney, Agent, or Firm*—Hodgson Russ Andrews Woods & Goodyear

[57] ABSTRACT

A gasket punch and method for forming a gasket hole. The gasket punch is a single piece having a spherical head and a handle whereby the punch may be used to form gasket holes of various sizes up to the spherical head diameter with the gasket material on the machine part or platen and without the necessity of first forming an error prone pattern in the gasket material. The handle may have a diameter which is less than the spherical head diameter whereby the handle may be easily held and manipulated and the amount of material of which the punch is composed may be minimized. In order to provide a suitably small handle diameter without unnecessarily reducing strength and toughness, the gasket punch is preferably composed of forged steel. The gasket hole is formed by aligning the spherical head over the machine part hole with the gasket material therebetween and striking the anvil end of the handle with a hammer or causing the spherical head to impact the gasket material by a machine so that the gasket material is pinched between the spherical head and the machine part or platen hole edge and thereby severed due to the force of impact.

15 Claims, 1 Drawing Sheet

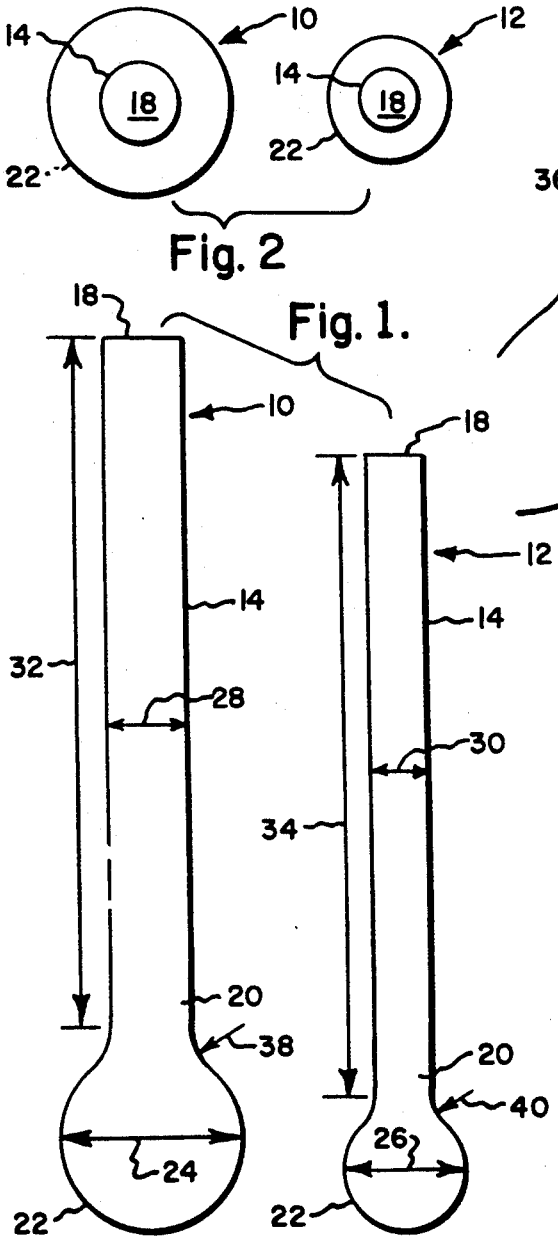
Fig. 2
Fig. 1.
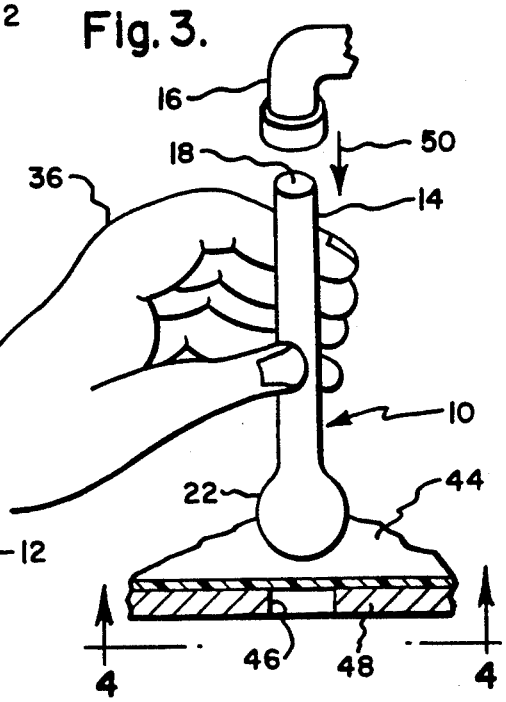
Fig. 3.
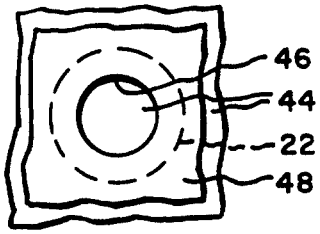
Fig. 4.
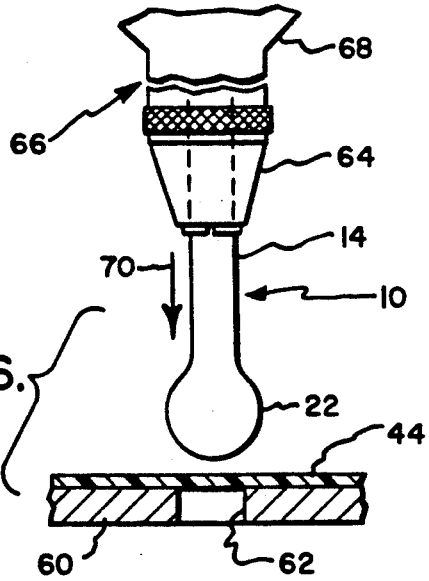
Fig. 6.
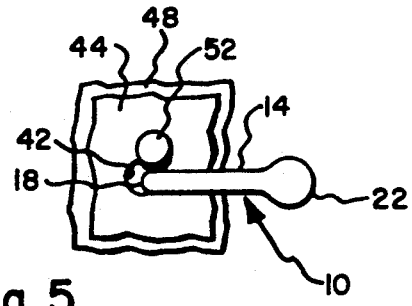
Fig. 5.

DEVICE AND METHOD FOR FORMING A GASKET HOLE

The present invention is related generally to the forming of holes in gaskets. More specifically, the present invention is related to a gasket punch and a method for forming holes in a gasket which correspond to holes in a machine part with which the gasket is to be used.

Conventionally, gasket punches have been composed of drop-forged tool steel or the like and provided in sets of perhaps 6 to 11 sized hole punches each producing a hole of a specific standard size by means of a head having a circular cutting edge which is punched into the gasket material by means of a hammer or the like. The hammer is caused to strike a small-diameter handle which is integrally attached to the head and which is held in one's hand for such use.

A conventional set of gasket punches disadvantageously normally require that a hole pattern be provided in the gasket material, the gasket material removed from the machine part after the pattern is made, and the hole then punched as indicated by the pattern. This is a time-consuming process and, if the pattern and punching are not formed carefully, errors may result with a corresponding waste of time and/or material. Furthermore, as previously noted, the craftsperson must undesirably carry around a large number of gasket punches in order to adequately perform the work. In addition, as the number of gasket punches in a set increases, the cost of the set also disadvantageously increases. Furthermore, such gasket punches may wear out after a period of time and thus have limited life.

It is accordingly an object of the present invention to provide a gasket punch which may be used to form gasket holes of various sizes so as to reduce the number of gasket punches required to perhaps one to three.

It is another object of the present invention to provide a gasket punch which permits the hole to be formed while the gasket material is positioned on the machine part so that it is unnecessary to first provide a pattern in the gasket material.

It is a further object of the present invention to provide such a gasket punch which is rugged, reliable, and of a single-piece construction yet is inexpensive to manufacture.

In accordance with the present invention there is provided a gasket punch which comprises an elongate handle means and means defining a spherical head integrally connected to one end of the handle means for punching a gasket hole, and the handle means has a diameter which is smaller than the spherical head diameter. Such a gasket punch may cooperate with a machine part or platen hole to produce a hole in gasket material which is of the same size as the machine part or platen hole up to the diameter of the spherical head whereby perhaps one to three such hole punches may replace an entire set of perhaps six to eleven conventional hole punches. The hole is punched while the gasket is positioned on the machine part or a platen carrying the desired hole pattern whereby it may be unnecessary to first provide a pattern in the gasket material for the hole. The spherical head is caused to impact the gasket material overlying a hole in the platen either by use of a hammer or the like or a machine to pinch the gasket material between the edge of the hole and the spherical head and thereby sever the gasket material due to the force of impact to provide a similar hole therein. The smaller diameter handle allows the expensive material of which the gasket punch is composed to be minimized while also allowing easier handling.

Various other objects, features, and advantages of the present invention will be more fully appreciated when considered in connection with the accompanying drawings in which like reference numerals designate the same or similar parts throughout the several views.

BRIEF DESCRIPTION OF THE DRAWINGS

FIG. 1 is a side view of a set of gasket punches in accordance with the present invention.

FIG. 2 is an end view of the set of gasket punches of FIG. 1.

FIG. 3 is a perspective view illustrating a process of punching a hole in gasket material in accordance with the present invention.

FIG. 4 is a view taken along lines 4–4 of FIG. 3.

FIG. 5 is a schematic view illustrating the removal of gasket hole material after the hole is punched therein.

FIG. 6 is a schematic view illustrating the use of a machine for punching a hole in gasket material in accordance with the present invention.

DETAILED DESCRIPTION OF THE PREFERRED EMBODIMENTS

Referring to FIGS. 1 and 2, there is shown at 10 and 12 a set of two gasket punches which are similar but of different sizes. Thus, gasket punch 12 may be used for punching relatively smaller gasket holes while gasket punch 10 may be used for relatively larger gasket holes. Except for this difference in sizes, gasket punches 10 and 12 may be described similarly so that description herein of one is meant to also refer to the other one. Like reference numerals will also refer to like parts thereof, and, with this understood, the description will be primarily with reference to gasket punch 10.

Gasket punch 10 is composed of a suitable material such as forged steel for suitably punching gasket holes as described hereinafter. It includes a shaft 14 that serves as a handle and transmits an impact force produced by a hammer, illustrated at 16 in FIG. 3, or other suitable means from the anvil end 18 to the working end 20.

A spherical head 22 is connected to the working end 20 of the shaft 14 and is integral therewith so that the gasket punch 10 is of a single-piece construction. The head 22 is provided with a spherical shape so that it may cooperate with a range of machine part hole sizes to transmit the impact force to pinch the gasket material, illustrated at 44 of FIG. 3, between the head 22 and the circumferential edge of the machine part hole, illustrated at 46 in FIG. 4, to advantageously thereby cut a hole in the gasket material to the size of the machine part hole while the gasket material is positioned on the machine part without the necessity of providing a pattern in the gasket material first, and the spherical shape, allowing such holes to be formed up to the diameter of the head, permits the number of gasket punches in a set to be minimized to perhaps one to three gasket punches.

The diameter of the head 22, illustrated at 24 for punch 10 and 26 for punch 12, must be larger than the diameter of the largest hole to be punched therewith. On the other hand, such a diameter for the handle 14 may cause the punch 10 to be difficult to handle and manipulate as well as requiring additional expensive tool steel in its manufacture. In order to minimize the amount of expensive tool steel required in the gasket punch 10 so that it may be manufactured more inexpensively as well as to provide a suitable handle size for easy holding and manipulation thereof, the diameter of the handle 14, illustrated at 28 for punch 10 and at 30 for punch 12, is preferably equal to less than about $\frac{5}{8}$ inch whereby it is less than the spherical head diameter 24 and 26 respectively, particularly where the spherical head diameter is greater than $\frac{5}{8}$ inch.

As shown in FIG. 3, the handle 14 preferably has a length, illustrated at 32 for punch 10 and 34 for punch 12, which is sufficient for easily holding and manipulating the gasket punch 10 by one's hand, illustrated at 36, and will generally increase as the spherical head diameter increases. Thus, the handle length 32 and 34 is preferably at least about 4 inches and should typically range between about 5 and 7 inches.

For accommodating a range of machine part hole sizes up to about $1\frac{1}{8}$ inches diameter, a set of two gasket punches 10 and 12 may be provided wherein the diameter 24 of the first punch 10 may be about $1\frac{1}{8}$ inches and the diameter 26 of the second punch 12 may be about $\frac{3}{4}$ inch. The handle 14 for gasket punch 10 may have a diameter 28 which is equal to perhaps about $\frac{5}{8}$ inch and a length 32 which is equal to about 6 inches. The handle 14 of gasket punch 12 may have a diameter 30 which is equal to perhaps about $\frac{1}{2}$ inch and a length 34 which is equal to perhaps about $5\frac{1}{4}$ inches. The junction between the handle 14 and head 22 of gasket punch 10 may be machined to have a radius illustrated at 38 of perhaps about 9/16 inch. The junction between the handle 14 and head 22 of the gasket punch 12 may be machined to have a radius, illustrated at 40, of perhaps $\frac{3}{8}$ inch. A third larger size gasket punch may be provided if it is desired to have the ability to punch holes greater than $1\frac{1}{8}$ inches in diameter. Thus, such a third gasket punch may, for example, have a head diameter of perhaps about $1\frac{1}{2}$ inch to punch holes having diameters from about $1\frac{1}{8}$ inches to about $1\frac{1}{2}$ inch, a handle diameter of perhaps about $\frac{5}{8}$ inch, and a handle length of perhaps about 6 inches. For another example, a set of three gasket punches may be provided wherein the spherical heads have diameters of $\frac{1}{4}$ inch for small holes up to $\frac{1}{4}$ inch diameter, $\frac{3}{4}$ inch for holes $\frac{1}{4}$ inch to $\frac{3}{4}$ inch diameter, and $1\frac{1}{2}$ inches for holes $\frac{3}{4}$ inch to $1\frac{1}{2}$ inch diameter. It should be understood that the above dimensions are for illustrative purposes only and not for purposes of limiting the scope of the present invention and that other embodiments having other dimensions may be provided which come within the scope of the present invention.

If desired, the handle 14 may be provided with a suitable knurl. For example, gasket punch 12 may be provided with a medium knurl over a length of $1\frac{1}{8}$ inches spaced 1 inch from the anvil end 18.

While the handle 14 has been shown as being cylindrical in shape, it should be understood that it may have any other suitable cross-sectional shape such as hexagonal. When describing such other shapes, the handle diameter 28 and 30 is defined herein as the largest dimension of the handle 14 as seen in a cross-sectional view taken in a plane perpendicular to the longitudinal direction thereof.

The gasket punches 10 and 12 should be hard and strong to maintain dimensional integrity yet must also resist spalling and other types of damage which can occur as a result of impact loadings. In order to provide such qualities, the gasket punches 10 and 12 are preferably produced from a medium/high-carbon alloy tool steel. Suitable shock-resisting tool steels may be characterized by, for example, a 0.5 percent carbon content and 1 to 2 percent silicon. Chromium, molybdenum, manganese, and tungsten may also be suitably alloyed in varying proportions in such steel for resistance to creep, wear, heat, and shock in accordance with principles commonly known to those of ordinary skill in the art to which this invention pertains. Examples of suitable tool steels are those within the range of about 4140 to 4150 tool steel. Although the punches 10 and 12 may be manufactured by casting in a dual-cavity die tooling or by welding steel ball bearings onto suitably shaped and formed handles or by any other suitable process, they are preferably manufactured by forging from tool steel. In order to withstand considerable impact loadings, the punches 10 and 12 may suitably be drop forged and heat-treated, including case hardening and tempering, in accordance with principles commonly known to those of ordinary skill in that art to which this invention pertains, and finished by machining burrs therefrom. The punches 10 and 12 are forged to concentrate the grain structures and fiber formation at the points of greatest shock and stress so that the grain structure is free of most internal defects with a more uniform structure that will help response to stress to be more predictable and to generally make the piece stronger and tougher. As opposed to cast or machined parts which are likely to be either straight or even without a particular grain flow, the grain flow of a forged part desirably follows the contour of the part. Forging permits the reduction of dead weight in parts simply for stress resistance and thus permits the diameter 28 and 30 of the handle 14 to be reduced without unnecessarily reducing strength and toughness.

Referring to FIGS. 3 to 5, there is illustrated a method of use of gasket punch 10 for forming a hole, illustrated at 42, in a piece of material 44 which corresponds to hole 46 in machine part 48 while the material 44 is positioned thereon so that it is unnecessary to first provide a pattern in the material 44. The material 44 may be any suitable relatively thin material in which it is desired to punch a hole conforming to a hole in a machine part or the like. For example, material 44 may be gasket material, which may have a thickness of perhaps 1/16 inch, shim stock, cardboard, leather material, sheet metal, or the like having a suitable thickness for punching a hole therein. Material 44 will be referred to hereinafter as "gasket material." The handle 14 is held in one's hand 36 and the punch 10 positioned so that the spherical head engages the gasket material 44 and is aligned over the machine part hole 46, as seen in FIG. 4, with the gasket material 44 being between the spherical head 22 and the machine part hole 46. The gasket punch 10 is then struck with a hammer 16 or the like as indicated at 50 on the anvil end 18 to transmit an impact force through the spherical head 22 to cause the gasket material 44 to be pinched between the rim or edge of the machine part hole 46 and the spherical head 22 and the head 22 forced through the gasket material 44 so that it is severed along the machine part hole edge. Each additional gasket hole corresponding to additional machine part holes is similarly punched while the gasket material 44 is held in position on the machine part 48. The gasket punch 10 can be used for machine part holes 46 having diameters up to the diameter 24 of its spherical head so that gasket punch 10 may replace several gasket punches having conventional circular cutting edges. Since the hole 42 and other required holes are punched while the gasket material 44 is on the machine part 48, it is no longer necessary to first provide a pattern, which may be error prone, in the gasket material 44.

Referring to FIG. 5, after the gasket hole 42 is punched, the severed blank of gasket material, illustrated at 52, may be conveniently removed therefrom by insertion of the relatively small diameter anvil end 18 of the gasket punch 10 and prying the blank 52 therefrom.

Referring to FIG. 6, there is illustrated an alternative method of use of gasket punch 10 for punching a hole or holes in gasket material 44 wherein gaskets with prepunched holes may be manufactured for sales to customers. The gasket material 44 is suitably positioned on a platen 60 which contains a hole 62 or holes corresponding to the sizes and locations of holes to be punched therein. The gasket punch 10 is aligned with the hole 62 and held in a chuck 64 of a suitable machine 66 which is built and preferably suitably programmed, in accordance with principles commonly known to those of ordinary skill in the art to which this invention pertains for automatic operation. Suitable means, illustrated at 68, are provided for providing reciprocating movement of the chuck 64 and the punch 10 carried thereby so that the gasket punch head 22 is moved, as illustrated at 70, toward the hole 62 and impacts the gasket material 44 to pinch the gasket material between the platen hole rim or edge and the spherical head and sever the gasket material due to the force of impact and thereby punch a hole of the same diameter in the gasket material, as previously discussed. A suitable machine with which gasket punch 10 may be used is, for example, a machine identified as a Strippit FC 1500/45 turret punch press marketed by the Strippit/Di-Acro Division of Houdaille Industries Inc. of Akron, N.Y. The handle 14 is of course suitably sized for the chuck 64.

Additional uses for punches 10 and 12 may include countersinking holes for screws, knocking out dents in fenders and sheet metal, as a knock-out punch for removing rusted bolts, and as a dry wall nail setter.

Thus, there is provided a single piece gasket punch for producing holes in gasket materials more easily and quickly. While the spherical head must be greater than the diameter of the largest hole to be punched therewith, the handle diameter is minimized for easier handling as well as for reducing the amount of expensive tool steel required for its manufacture. Forging of the punch permits such a minimized handle diameter without unnecessarily reducing strength and toughness. A single gasket punch of the present invention may be long wearing and replace several gasket punches having conventional relatively fast wearing circular cutting heads for added convenience to the craftsperson.

It is to be understood that the invention is by no means limited to the specific embodiments which have been illustrated and described herein and that modifications may indeed be made which come within the scope of the present invention as defined by the appended claims.

What is claimed is:

1. A method for punching a gasket hole corresponding to a hole in a platen comprising the steps of:

a. positioning a piece of gasket material on the platen in overlying relation to the platen hole;

b. providing a single piece gasket punch which includes a handle and a spherical head integrally connected to one end of the handle, the spherical head having a diameter greater than the diameter of the platen hole;

c. holding the single piece gasket punch with the spherical head aligned with the platen hole and with the gasket material between the spherical head and the platen hole;

d. causing the spherical head to impact the gasket material overlying the platen hole to pinch the gasket material between the spherical head and an edge of the platen hole and thereby sever the gasket material whereby a hole may be punched in the gasket material which is of the same diameter as the platen hole; and e. inserting an other end of the handle in the punched hole and removing the severed gasket material therewith.

2. A method according to claim 1 further comprising selecting the gasket punch to have a handle diameter which is less than the spherical head diameter.

3. A method according to claim 1 further comprising selecting the gasket punch to be composed of forged steel.

4. A method according to claim 1 wherein the step of holding the gasket punch comprises holding the handle in a machine chuck which is movable for causing the spherical head to impact the gasket material overlying the platen hole.

5. A method according to claim 1 wherein the platen is a machine part and the step of causing the spherical head to impact the gasket material comprises holding the handle in a hand with the spherical head engaging the gasket material and aligned with the machine part hole and striking an other end of the handle.

6. A single piece gasket punch composed of forged steel comprising an elongate handle means having a diameter and two ends, a spherical head integrally connected to one end of said handle means for punching a gasket hole when said spherical head is aligned with a platen hole with gasket material disposed therebetween and the gasket material overlying the platen hole is impacted by the spherical head, the diameter throughout the length of the handle means being less than the diameter of the spherical head whereby the other end of the handle means is insertable into the platen hole to dislodge severed gasket material therefrom.

7. A gasket punch according to claim 6 wherein said handle means has a length which is equal to at least about 4 inches.

8. A gasket punch according to claim 6 wherein said handle means has a length which is equal to between about 5 and 7 inches.

9. A gasket punch according to claim 6 wherein said handle means diameter is less than about ⅜ inch.

10. A set of at least two gasket punches each being a single piece composed of forged steel and comprising an elongate handle means having a diameter and two ends, a spherical head integrally connected to one end of said handle means for punching a gasket hole when said spherical head is aligned with a platen hole with gasket material disposed therebetween and the gasket material overlying the platen hole is impacted by the spherical head, the diameter throughout the length of the handle means being less than the diameter of the spherical head whereby the other end of the handle means is insertable into the platen hole to dislodge severed gasket material therefrom, said spherical head of one of said gasket punches having a first diameter for a first plurality of gasket hole sizes, and said spherical head of another of said gasket punches having a second diameter which is different from said first diameter for a second plurality of gasket hole sizes.

11. A set of gasket punches according to claim 10 wherein said handle means of each of said gasket punches has a length which is equal to at least about 4 inches.

12. A set of gasket punches according to claim 10 wherein said first diameter is equal to about $\frac{3}{4}$ inch and said second diameter is equal to about $1\frac{1}{8}$ inches.

13. A set of gasket punches according to claim 12 wherein said handle means of each of said gasket punches has a diameter which is equal to less than about $\frac{5}{8}$ inch.

14. A set of gasket punches according to claim 12 wherein said handle means of said one gasket punch has a diameter which is equal to about $\frac{1}{2}$ inch and said handle means of said another gasket punch has a diameter which is equal to about $\frac{5}{8}$ inch.

15. A set of gasket punches according to claim 14 wherein said handle means of said one gasket punch has a length which is equal to about $5\frac{1}{4}$ inches and said handle means of said another gasket punch has a length which is equal to about 6 inches.

* * * * *